US006257570B1

(12) United States Patent
Ficyk

(10) Patent No.: US 6,257,570 B1
(45) Date of Patent: Jul. 10, 2001

(54) ENHANCED SHEET FEED ADAPTED FOR DUAL WEB FORMS

(75) Inventor: Charles C. Ficyk, Parma, OH (US)

(73) Assignee: Morgan Adhesives Company, Stow, OH (US)

( * ) Notice: Subject to any disclaimer, the term of this patent is extended or adjusted under 35 U.S.C. 154(b) by 0 days.

(21) Appl. No.: 09/377,653

(22) Filed: Aug. 19, 1999

(51) Int. Cl.[7] ..... B65H 1/12
(52) U.S. Cl. ..... 271/148; 271/241; 271/145
(58) Field of Search ..... 271/145, 147, 271/148, 160, 171, 241; 221/64, 58, 59, 241; 24/482, 456, 499, 500, 501, 509, 510, 511

(56) References Cited

U.S. PATENT DOCUMENTS 1,542,208 * 6/1925 Berger ..... 24/510 X
3,076,243 * 2/1963 Fauteux ..... 24/512
3,740,803 * 6/1973 Arteburn ..... 24/482 X
3,914,828 * 10/1975 Noda ..... 24/510 X
4,084,299 * 4/1978 Noda ..... 24/510 X
4,141,119 * 2/1979 Nodo ..... 24/510 X
5,697,298 * 12/1997 Greive et al. ..... 271/241 X

* cited by examiner

*Primary Examiner*—Christopher P. Ellis
*Assistant Examiner*—Patrick Mackey
(74) *Attorney, Agent, or Firm*—Renner, Kenner, Greive, Bobak, Taylor & Weber

(57) ABSTRACT

An enhanced sheet feed adapter for dual web forms serves to close the gap between the leading edge of the forms and the exit ramp of the paper tray. The adapter includes a pair of hingedly interconnected plates having a spring interposed between them. A front one of the plates urges a stack of dual web forms toward the ramp to close such gap.

18 Claims, 2 Drawing Sheets

ENHANCED SHEET FEED ADAPTED FOR DUAL WEB FORMS

TECHNICAL FIELD

The present invention relates generally to printer media feeding systems and, more particularly, to an insert spacer device for printer feed trays for use in conjunction with paper or the like, such as dual web forms having variable thicknesses along their lengths.

BACKGROUND ART

A basic sheet fed printer feed tray, as shown in FIG. 1, has an angled front plate 1 and a positionally adjustable angled rear plate 2 between which rests a stack 3 of printable material such as paper, vinyl, polyester and the like. The angle of rear plate 2 is slightly less than the angle of front plate 1 so that, when the stack of paper 3 is properly placed in the feed tray so that its rear edge rests against rear plate 2, a small gap 4 exists between the leading edge of the paper 3 and the front plate 1. The top sheet of the stack of paper 3 is urged into the paper path 5 by rollers 6 (only one of which is shown) which are biased toward the paper stack 3 and which drive the top sheet of paper stack 3 onto the ramp of front plate 1 where it is directed into paper path 5. Although there is a space provided by gap 4 into which the top sheet of the paper 3 could downwardly extend and thereby fail to be directed into paper path 5, this very rarely occurs because gap 4 is quite small. However, the size of the gap 4 is dramatically increased, and jamming problems and/or damage to the leading edge of the paper or other media frequently occur, when a common feed tray as described hereinabove is used to feed paper having variable thickness along its length.

The present invention deals generally with the problem encountered when feed trays are used to feed paper of variable thickness. More specifically, the invention deals with the problems encountered when feed trays are used to feed dual web forms to a printer. A type of dual web form, as now known in the art, is depicted in FIG. 2. Such dual web forms are sheets of variable thickness having a thicker, pressure sensitive adhesive portion 7 separated by perforations 8 from a thinner paper portion 9. A face paper 10 is separated along its length by perforations 8. On one side of the perforation 8, the face paper 7 contains a pressure sensitive adhesive 11 which is releasably adhered to a silicone release layer 12 carried on a backing sheet 13.

An exemplary common use for these dual web forms is the creation of labels for prescription medication. By properly configuring a printer and associated program, a pharmacist can have prescription information printed on a label on the pressure sensitive adhesive portion 7 of the dual web form and, at the same time, can have the same or related information printed on the paper portion 9. The labels, now bearing the prescription information, can be removed from the backing sheet 13 bearing the silicone release layer 12 and applied to a patient's bottle of prescription medication, while the prescription information printed on the paper portion 9 of the dual web form can be separated from the label portion by tearing along the perforation 8 and can then be placed in the pharmacist's files and/or be given to the patient. However, the use of dual web forms with a printer having a common feed tray tends to jam the printer.

A jamming problem arises with the use of dual web forms due to the fact that the pressure sensitive adhesive portion 7 of the dual web form is thicker than the paper portion 9. Dual web forms are stacked in a feed tray with the thicker, pressure sensitive adhesive portion 7 directed toward the ramped front plate 1 and, as can be seen in FIG. 3, the variable thickness of the dual form causes a significant increase in the size of the gap 4 when a stack of dual web forms are placed in the feed tray. When the rollers 6 attempt to feed the top dual web form into the paper path 5, the leading edge of the dual web form has a greater tendency to feed downwardly into the large gap 4 and jam the printer as at 15. This problem is especially apparent when individual forms in the stack of dual web forms in the feed tray happen to have a slight downward curve at their leading edge. This downward curve may result from an inherent curl characteristic of many laminates as a result of ambient humidity conditions, or it may result from mechanical deformation of the laminate. Moreover, the size of the gap 4 is such that quickly closing a feed tray or accidentally jostling the tray around may cause the top dual web forms on the stack to shift and extend into the gap 4 thereby creating a jamming situation before feeding from the paper stack 3 has even been attempted. The size of the gap 4 will depend upon the variation in thickness along the form's length as well as the overall thickness of the stack placed in the feed tray. Generally, the size of the gap with such dual web forms can range from about 0.25 to about 0.5 inches, with the larger gaps tending to result in jams more often. It has been found that the gap 4 is generally doubled when dual web forms are used, as compared to sheets of uniform thickness.

Therefore, there exists a need in the art for a feed device for printer feed trays that will prevent stacks of paper or other sheet material or other sheet material of variable thickness from jamming the printer.

SUMMARY OF THE INVENTION

In light of the foregoing, it is an aspect of the present invention to provide a sheet feed adapter for sheet fed printers that eliminates the tendency of the printer to jam when the feed tray is feeding from a stack of paper or other sheet material having variable thickness along its length.

Another aspect of the present invention is to provide a sheet feed adapter for sheet fed printers that reduces the gap between the leading edge of the stack of sheets within the feed tray and the paper path.

Still another aspect of the present invention is to provide a sheet feed adapter for sheet fed printers that reduces the gap between the leading edge of the stack of sheets and the paper path for various stack heights.

DESCRIPTION OF THE DRAWINGS

For a complete understanding of the objects, techniques and structure of the invention reference should be made to the following detailed description and accompanying drawings wherein.

PREFERRED EMBODIMENT OF THE INVENTION

Figure 1:
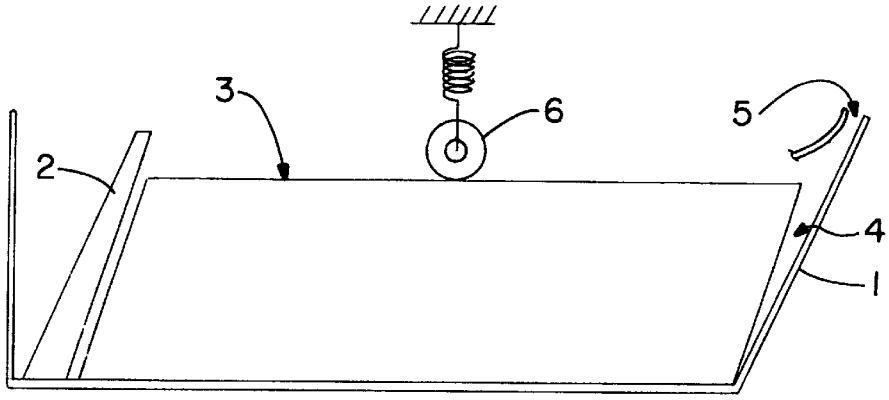
FIG.-1 Prior Art
FIG. 1 is a side view of a prior art feed tray for a sheet fed printer.
Figure 2:
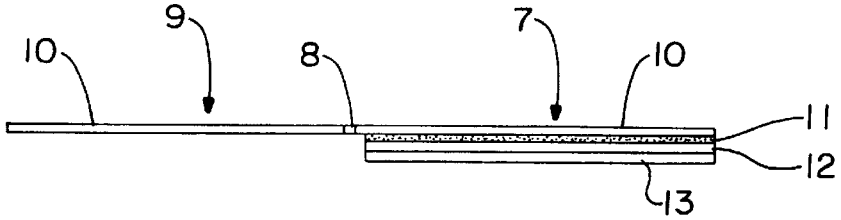
FIG.-2 Prior Art
FIG. 2 is a side view of a dual web form as commonly known in the art.
Figure 3:
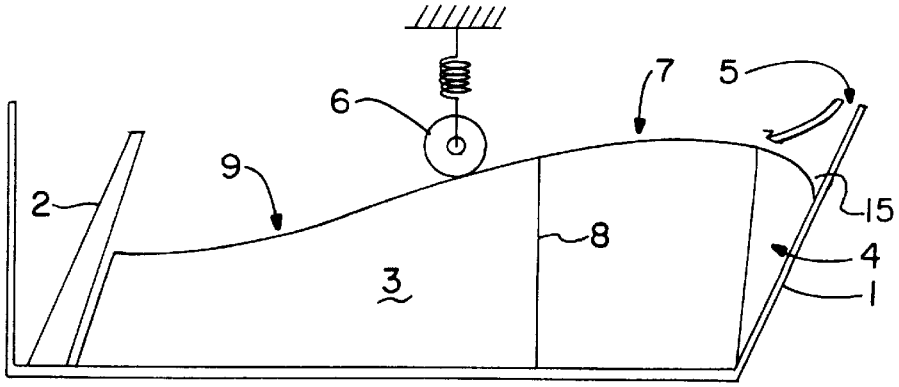
FIG.-3 Prior Art
FIG. 3 is a side view of a feed tray for a sheet fed printer showing the problem encountered when a stack of sheets having variable thickness along their length are placed therein.
Figure 5:
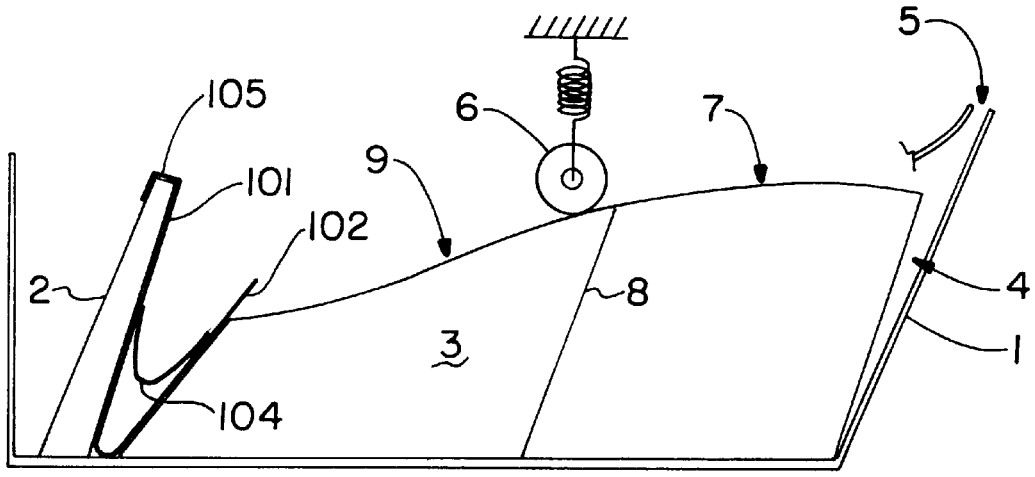
FIG. 5 is a side view of the a feeding tray for sheet fed printers having the sheet feed adapter of the present invention attached thereto.
Figure 4:
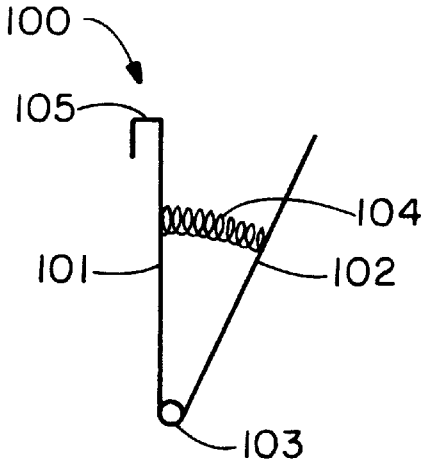
FIG. 4 is a side view of the sheet feed adapter of the present invention.

Referring now to FIGS. 4 and 5 it can be seen that the sheet feed adapter of the present invention is designated generally by the numeral 100. The sheet feed adapter 100 has a rear plate 101 attached to a front plate 102 by a hinge 103. Front plate 102 is biased away from rear plate 101 by a spring mechanism 104. Rear plate 101 carries a clip 105 at the upper end thereof.

Clip 105 is adapted to attach sheet feed adapter 100 to rear plate 2 of the feed tray. When attached, the rear plate 101 of sheet feed adapter 100 is held substantially flush against and substantially continuous with the rear plate 2 of the feed tray and spring mechanism 104 biases front plate 102, of a size generally corresponding to plate 101, at an angle away from rear plate 2. Thus, the paper stack 3 placed in the feed tray between the front plate 102 of the sheet feed device 100 and the front plate 1 of the feed tray is biased towards the front plate 1 of the feed tray regardless of the existence of a variation in thickness along the length of the paper 3. Biasing the stack of papers 3 toward front plate 1 substantially eliminates the existence of gap 4, thereby allowing rollers 6 to properly feed the top sheet of papers 3 into the paper path 5. With the gap 4 reduced or substantially eliminated, and with the sheets of paper stack 3 being in substantial contact with the ramp of front plate 1, the urging of the rollers 6 is effective to move the sheets of material up the ramp and into the paper path 5.

Spring mechanism 104 allows the sheet feed adapter 100 to be self adjusting. Since the size of gap 4 is a function of the variation in thickness along the length of the sheets stacked in the feed tray and it is desired that sheet feed adapter 100 be capable of eliminating gaps of various sizes, the adaptive nature of the adapter 100 is quite beneficial.

Figure 6:
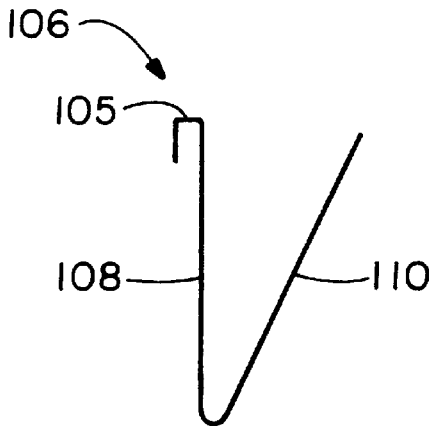
FIG. 6 is a side view of a second embodiment of the invention.

It should be understood that spring mechanism 104 may be of various natures to bias front plate 102 away from rear plate 101. For example, in addition to the coil springs shown, the use of foam strips, leaf springs or pieces of spring steel are contemplated. Indeed, as shown in FIG. 6, sheet feed adapter 106 may be formed of a single piece of spring steel which is naturally biased toward a v-shape adequate to reduce the gap 4 between the paper stack 3 and the front plate 1 of the feed tray. Such a configuration would typically have a rear leg 108 and a front leg 110, corresponding to the plates 101, 102 of the adapter 100.

As mentioned above, the size of the gap 4 is a function of the height of the stack of papers 3 placed in the feed tray as well as the variation in thickness along the length of the sheets thereof. Therefore, the biased angle between front plate 102 and rear plate 101, or rear leg 108 and front leg 110, may also vary in the design of sheet feed device 100. It has been found, and is noted here, without limitation, that the angle between plates 102 and 101 or legs 108 and 110 should, before insertion into the paper tray and contact with the paper stack 3, normally range between 25° and 45°, with an angle of 35° being preferred.

What is claimed is:

1. A feed tray for sheet fed printers in combination with a device for effecting the efficient feeding of sheet material having variable thickness, comprising:

a feed tray for sheet fed printers receiving a stack of sheet material of variable thickness;

a rear plate received within said feed tray;

a front plate;

a hinge connecting said front plate to said rear plate at one end thereof; and a spring mechanism interposed between said front and rear plates and urging another end of said front plate away from said rear plate such that said front and rear plates form a v-shape, said front plate engaging and urging said stack of sheet material away from said front plate.

2. The combination according to claim 1, further comprising a clip for releasably attaching said rear plate to the feed tray for sheet fed printers.

3. The combination according to claim 2, wherein said clip is integrally formed on said rear plate.

4. The combination according to claim 1, wherein said spring mechanism is a spring attached to said rear plate and said front plate near the ends of said plates opposite the ends of said plates that are connected by said hinge.

5. The combination according to claim 1, wherein said angle of the v-shape formed by said front and rear plates is from about 25 degrees to about 45 degrees.

6. The combination according to claim 5, wherein the angle of the v-shape formed by said front and rear plates is 35 degrees.

7. A feed tray for sheet fed printers in combination with a device for effecting the efficient feeding of sheet material having variable thickness, comprising:

a feed tray for sheet printers receiving a stack of sheet material of variable thickness;

a rear plate received within said feed tray;

a front plate; and a hinge connecting said front plate to said rear plate at one end thereof and urging another end of said front plate away from said rear plate such that said front and rear plates form a v-shape, said front plate engaging and urging said stack of sheet material away from said front plate.

8. The combination according to claim 7, further comprising a clip for releasably attaching said rear plate to the feed tray for sheet fed printers.

9. The combination according to claim 8, wherein sid clip is integrally formed on said rear plate.

10. The combination according to claim 7, wherein the angle of the v-shape formed by said front and rear plates is from about 25 degrees to about 45 degrees.

11. The combination according to claim 10, wherein the angle of the v-shape formed by said front and rear plates is 35 degrees.

12. A combination for use in conjunction with a feed tray for sheet fed printers, comprising a single piece of resilient material normally biased towards a v-shape.

13. The combination according to claim 12, further comprising a clip for releasably attaching said single piece of resilient material to the feed tray for sheet fed printers.

14. The combination according to claim 13, wherein said clip is integrally formed on said rear plate.

15. A feed tray for sheet fed printers feeding sheet material having variable thickness along its length, comprising:

an angled front plate;

an angled rear plate;

a biased plate;

a hinge connecting said biased plate to said angled rear plate at a first end thereof; and a spring mechanism interposed between said angled rear plate and said biased plate and urging said biased plate away from a second end of said angled rear plate such that said angled rear plate and said biased plate form a v-shape.

16. The feed tray for sheet fed printers according to claim 15, wherein the angle formed by said angled rear plate and said biased plate is from about 25 degrees to about 45 degrees.

17. The feed tray for sheet fed printers according to claim 16, wherein the angle formed by said angled rear plate and said biased plate is 35 degrees.

18. A feed tray for sheet fed printers feeding sheet material having variable thickness along its length comprising an angled front plate and an angled rear plate, said angled rear plate having a biased plate extending therefrom in contacting engagement with said sheet material, said rear plate being selectively positionable to compensate for the variable thickness of the sheet material and ensure that the sheet material is urged uniformly towards said angled front plate.

* * * * *